US010332455B2

(12) United States Patent
Chun et al.

(10) Patent No.: US 10,332,455 B2
(45) Date of Patent: Jun. 25, 2019

(54) ORGANIC LIGHT-EMITTING DISPLAY DEVICE AND DISPLAY METHOD THEREOF

(71) Applicant: Samsung Display Co., Ltd., Yongin (KR)

(72) Inventors: Byungki Chun, Yongin (KR); Jeonghun So, Yongin (KR); Wonwoo Jang, Yongin (KR)

(73) Assignee: Samsung Display Co., Ltd, Yongin-si (KR)

( * ) Notice: Subject to any disclaimer, the term of this patent is extended or adjusted under 35 U.S.C. 154(b) by 801 days.

(21) Appl. No.: 14/740,973

(22) Filed: Jun. 16, 2015

(65) Prior Publication Data

US 2016/0133194 A1 May 12, 2016

(30) Foreign Application Priority Data

Nov. 6, 2014 (KR) ..... 10-2014-0153735

(51) Int. Cl.
*G09G 3/3225* (2016.01)
*G09G 3/3275* (2016.01)

(52) U.S. Cl.
CPC ..... *G09G 3/3275* (2013.01); *G09G 3/3225* (2013.01); *G09G 2320/0233* (2013.01); *G09G 2320/0242* (2013.01); *G09G 2320/0666* (2013.01); *G09G 2320/0673* (2013.01); *G09G 2320/08* (2013.01)

(58) Field of Classification Search
CPC ..... G09G 3/3275; G09G 3/3225; G09G 2320/08; G09G 2320/0666; G09G 2320/0673; G09G 2320/0233; G09G 2320/0242
See application file for complete search history.

(56) References Cited

U.S. PATENT DOCUMENTS

2004/0109091 A1 6/2004 Park et al.
2006/0001624 A1* 1/2006 Lee ..... G09G 3/3233 345/82
2006/0238551 A1* 10/2006 Dalal ..... G09G 3/002 345/690
2009/0284456 A1* 11/2009 Song ..... G09G 3/3655 345/94

(Continued)

FOREIGN PATENT DOCUMENTS

KR 10-2004-0048791 6/2004
KR 10-2010-0097213 9/2010

(Continued)

*Primary Examiner* — Nicholas J Lee
*Assistant Examiner* — Gerald L Oliver
(74) *Attorney, Agent, or Firm* — H.C. Park & Associates, PLC

(57) ABSTRACT

An organic light-emitting display device includes: a display panel including a plurality of pixels, each of the plurality of pixels including an organic light-emitting device configured to emit colored light; a gamma data generating unit configured to generate gamma data corresponding to received RGB data; a correction rate calculating unit configured to determine a luminance correction rate of each of the plurality of pixels based on the gamma data respectively corresponding to the plurality of pixels; and a correction value determining unit configured to determine a luminance correction value of a color displayed via each of the plurality of pixels.

10 Claims, 6 Drawing Sheets

(56) References Cited

U.S. PATENT DOCUMENTS

| | | | | |
|---|---|---|---|---|
| 2011/0025728 | A1 | 2/2011 | Baba et al. | |
| 2012/0133681 | A1* | 5/2012 | Hsiao | G09G 3/2007 345/690 |
| 2012/0242710 | A1 | 9/2012 | Kang | |
| 2015/0097765 | A1 | 4/2015 | Chun et al. | |
| 2015/0279284 | A1* | 10/2015 | Yano | G09G 3/3208 345/690 |

FOREIGN PATENT DOCUMENTS

| | | |
|---|---|---|
| KR | 10-2012-0066250 | 6/2012 |
| KR | 10-2012-0108445 | 10/2012 |
| KR | 10-2015-0039996 | 4/2015 |

* cited by examiner

ORGANIC LIGHT-EMITTING DISPLAY DEVICE AND DISPLAY METHOD THEREOF

CROSS-REFERENCE TO RELATED APPLICATION

This application claims priority from and the benefit of Korean Patent Application No. 10-2014-0153735, filed on Nov. 6, 2014, which is hereby incorporated by reference for all purposes as if fully set forth herein.

BACKGROUND

Field

Exemplary embodiments relate to an organic light-emitting display device and a display method thereof, and, more particularly, to an organic light-emitting display device configured to display colors and luminance by correcting a display luminance according to a target luminance of an individual pixel and a display method of the organic light-emitting display device.

Discussion of the Background

An organic light-emitting display device is a type of flat panel display device in which an organic compound is used as a light-emitting material, that has improved luminance and color purity, is thin and light in weight, and can be driven with low power consumption. Thus, the organic light-emitting display device may be useful in various display devices such as portable display devices.

An organic light-emitting display device includes a plurality of pixels that display one of red, green, and blue colors, and emits light at a luminance corresponding to a data voltage applied to each of the plurality of pixels.

An emission luminance of each pixel corresponds to a data voltage, and data voltages of different magnitudes are applied according to a target luminance. However, an actual emission luminance of each pixel may be influenced by the luminance of peripheral pixels.

Thus, although a data voltage corresponding to a target luminance is applied, light may not be emitted at an accurate luminance due to the influence of luminance of peripheral pixels or exact colors may not be displayed due to an inaccurate luminance.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide organic light-emitting display devices capable of reducing an emission luminance error caused by a difference of luminance of an individual pixel with respect to the luminance of peripheral pixels, and display methods of the organic light-emitting display devices.

Additional aspects will be set forth in the detailed description which follows, and, in part, will be apparent from the disclosure, or may be learned by practice of the inventive concept.

According to one or more exemplary embodiments, an organic light-emitting display device includes: a display panel including a plurality of pixels, each of the plurality of pixels including an organic light-emitting device configured to emit colored light; a gamma data generating unit configured to generate gamma data corresponding to received RGB data; a correction rate calculating unit configured to determine a luminance correction rate of each of the plurality of pixels based on the gamma data respectively corresponding to the plurality of pixels; and a correction value determining unit configured to determine a luminance correction value of a color displayed via each of the plurality of pixels.

According to one or more exemplary embodiments, a method includes: receiving RGB data associated with driving a display panel including a plurality of pixels, the plurality of pixels respectively including an organic light-emitting device configured to emit colored light; generating gamma data corresponding to the RGB data; determining a luminance correction rate for each pixel of the plurality of pixels based on the gamma data respectively corresponding to the plurality of pixels; and determining a luminance correction value of a color displayed via each of the plurality of pixels; and providing corrected RGB data corresponding to correction gamma data to a pixel corresponding to the corrected RGB data, wherein the luminance correction value is applied to the correction gamma data.

These general and specific embodiments may be implemented using a system, a method, a computer program, or a combination of the system, the method, and the computer program.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
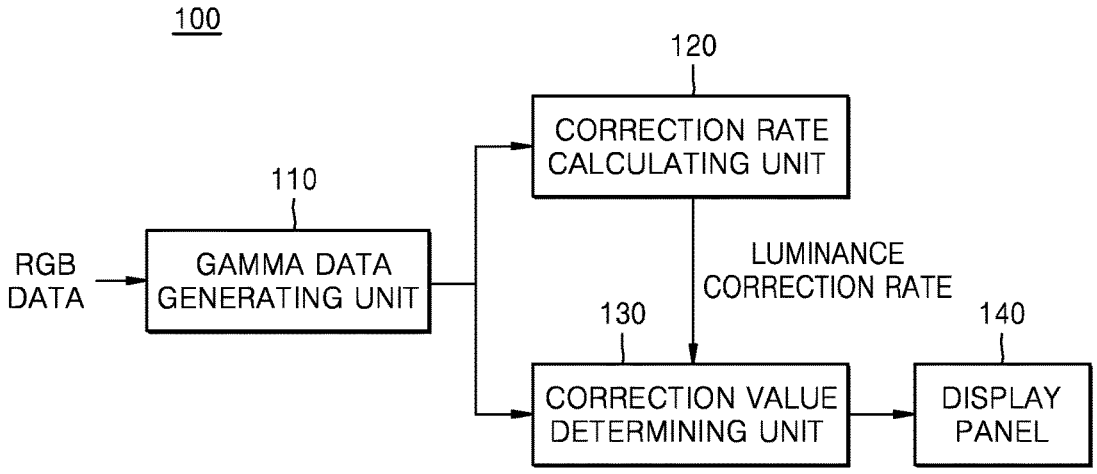
FIG. 1 is a schematic structural diagram illustrating an organic light-emitting display device, according to one or more exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a schematic structural diagram illustrating an organic light-emitting display device 100 according to one or more exemplary embodiments.

Referring to FIG. 1, the organic light-emitting display device 100 includes a gamma data generating unit 110, a correction rate calculating unit 120, a correction value determining unit 130, and a display panel 140.

The display panel 140 includes a plurality of pixels, and each of the plurality of pixels displays one of a plurality of colors including, but not limited to, red, green, and blue colors.

The pixels may display one of red, green, and blue colors, and the pixel displaying the red color, the pixel displaying the green color, and the pixel displaying the blue color may be repeatedly disposed. Also, a user may perceive a light combined of at least one of the red, green, and blue color lights displayed via adjacent pixels.

Also, each of the plurality of pixels includes an organic light-emitting device. When a data signal of a maximum gradation level is applied to the pixels configured to display the red, green, and blue colors, the organic light-emitting devices included in the pixels may emit light of red, green, and blue colors having the highest gradation level, which may be mixed to produce white light.

When a data signal of a high gradation level is applied to the pixels displaying red and green colors, and a data signal of a low gradation level is applied to a pixel displaying a blue color, the organic light-emitting devices included in the pixels may emit red color light and green color light having a high gradation level and blue color light having a low gradation level, which may be mixed to produce yellow-based light.

The gamma data generating unit 110 is configured to generate gamma data corresponding to received RGB data. The gamma data generating unit 110 receives pieces of RGB data with respect to each of the three primary colors, red, green, and blue, and converts the pieces of RGB data into gamma data with respect to each of the three primary colors based on each piece of RGB data.

The gamma data may be understood as data that includes luminance information of each color. Gamma data or gamma level may be converted into its corresponding luminance according to a gamma curve, and its corresponding luminance may vary according to a gamma value of the gamma curve.

For example, the RGB data may be data of a total of 24 bits, and each piece of 8-bit data may be RGB data of a red, green, or blue color. The gamma data generating unit 110 converts each piece of 8-bit data corresponding to red, green, and blue colors into gamma data including luminance information of each color.

The correction rate calculating unit 120 is configured to calculate a luminance correction rate of each pixel based on gamma data corresponding to each pixel.

An image displayed via the display panel 140 of the organic light-emitting display device 100 is displayed via a plurality of pixels that display one of red, green, and blue colors, and the luminance of a color displayed on a particular pixel may be brighter or darker than the luminance intended by the input data according to luminance of colors displayed on peripheral pixels.

Luminance of colors displayed on peripheral pixels may correspond to an average luminance of all the pixels that form one frame. According to whether emission luminance of the particular pixel is higher or lower than the luminance of colors displayed on peripheral pixels, the luminance of the particular pixel may be displayed brighter or darker than the luminance intended to be displayed, that is, a target luminance.

Therefore, in the pixel displaying brighter luminance than the target luminance, the luminance may be corrected by reducing the luminance thereof, and in the pixel displaying darker luminance than the target luminance, the luminance may be corrected by increasing the luminance thereof.

The correction rate calculating unit 120 calculates a luminance correction rate for luminance correction, and the luminance correction rate corresponds to the target luminance for the luminance correction.

For example, different luminance correction rates may be applied to pixels that emit light having higher luminance than the average luminance of all the pixels, instead of applying an identical luminance correction rate thereto. That is, the luminance correction rate may be understood as a value dependent upon a target luminance of each individual pixel.

The correction value determining unit 130 determines a luminance correction value of a color displayed on each of the plurality of pixels. The correction value determining unit 130 receives gamma data, which corresponds to the individual pixel that the luminance is to be corrected, and the luminance correction rate calculated by the correction rate calculating unit 120, and is configured to determine a correction value corresponding to the received gamma data and the received luminance correction rate.

The gamma data is generated by the gamma data generating unit 110 that receives RGB data, and the plurality of pixels emit light of a luminance corresponding to the gamma data according to a gamma curve used by the organic light-emitting display device 100. Thus, the gamma data may be understood as a concept corresponding to luminance.

The correction value determining unit 130 determines a correction value corresponding to the gamma data which corresponds to the individual pixel and the luminance correction rate, and is configured to provide the plurality of pixels with corrected RGB data based on the gamma data with the correction value reflected.

Figure 2:
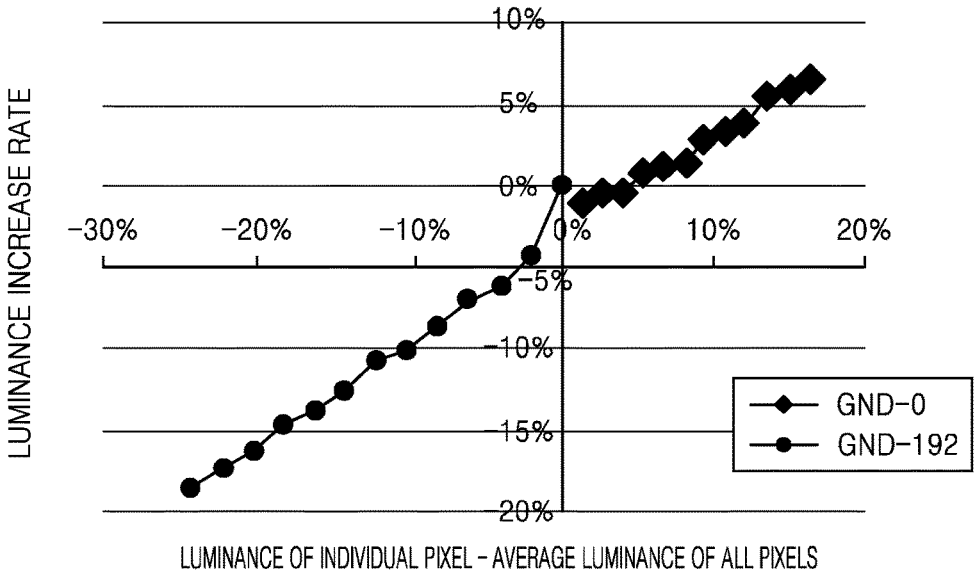
FIGS. 2 and 3 are graphs showing a luminance increase rate of an individual pixel with respect to an average luminance of the entire panel according to a gamma level.
Figure 3:
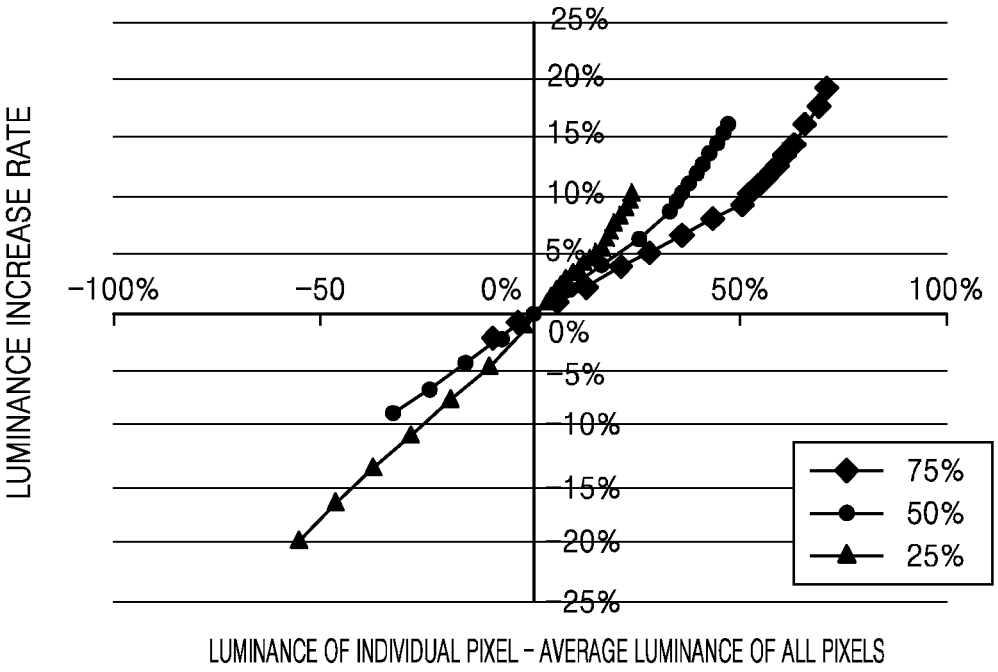

FIGS. 2 and 3 are graphs showing a luminance increase rate of an individual pixel with respect to an average luminance of the entire panel according to a gamma level.

FIG. 2 shows a luminance increase rate of the individual pixel according to a difference between the luminance of an individual pixel and an average luminance of all the pixels. Referring to FIG. 2, the horizontal axis denotes a difference between the luminance of an individual pixel and an average luminance of all the pixels (luminance of an individual pixel–average luminance of all the pixels), and the vertical axis denotes a luminance increase rate. Here, the luminance of the individual pixel and the average luminance of all the pixels may be obtained from a target luminance of each pixel induced from gamma data generated by the gamma data generating unit 110.

A gamma level is a value which has the meaning substantially same as the gamma data, and as gamma data and a display luminance correspond to each other, the gamma level and the display luminance corresponds to each other. Thus, the luminance of an individual pixel corresponds to a gamma level of the individual pixel, and an average luminance of all the pixels corresponds to an average gamma level of all the pixels.

The graph of FIG. 2 shows exemplary luminance increase rate according to a gamma level 0 (GND-0) and a gamma level 192 (GND-192), wherein the gamma level of 0 indicates the lowest luminance of a color of light emitted from a pixel, and the gamma level of 255 indicates the highest luminance, when driven in 8-bit-color. Here, a gamma level of 192 (GND-192) denotes a gamma level of light having a luminance of 50% when the maximum luminance is assumed to be 100%. For example, in a display panel having a maximum luminance of 300 nit, a gamma level of 192 represents a gamma level of light having luminance of 150 nit.

Referring to the graph of FIG. 2, when a gamma level is 0 (GND-0), and a difference between the luminance of an individual pixel and an average luminance of all the pixels is −10%, that is, when luminance corresponding to gamma data applied to the individual pixel is lower than the average luminance of all the pixels by 10%, the corresponding pixel displays a light having a luminance 10% less than the luminance of a color originally intended to be displayed.

Also, when a gamma level is 192 (GND-192), and a difference between a luminance of an individual pixel and the average luminance of all the pixels is 10%, that is, when luminance corresponding to gamma data applied to the individual pixel is higher than the average luminance of all the pixels by 10%, the corresponding pixel displays a light having a luminance 3% brighter than the luminance of a color originally intended to be displayed.

For both of the gamma level 0 and 192, when there is no difference between the luminance of an individual pixel and an average luminance of all the pixels, a variation in luminance of the actually displayed color is substantially small.

Referring to the graph of FIG. 2, a display luminance of an individual pixel may vary depending on the difference between the display luminance of the individual luminance and the average luminance of all the pixels, and a degree of difference in the display luminance has a tendency to increase according to an increase in the difference between the display luminance of the individual luminance and the average luminance of all the pixels. Such tendency indicates that the emission luminance of the individual pixel may not be controlled as intended, and therefore, color error and luminance error may be caused. Thus, the luminance may be corrected by increasing or decreasing.

FIG. 3 is a graph showing an increase and decrease of an actual display luminance according to a difference between a luminance of an individual pixel and an average luminance of all the pixels.

The plotted graphs illustrated in FIG. 3 respectively indicate a luminance increase rate at luminance of 75%, 50%, and 25% when the maximum luminance of an individual pixel is assumed to be 100%.

Like the graph illustrated in FIG. 2, in the graph of FIG. 3, the horizontal axis denotes a difference between the luminance of an individual pixel and an average luminance of all the pixels (luminance of an individual pixel—average luminance of all the pixels), and the vertical axis denotes a luminance increase rate in FIG. 3.

Also, as described with reference to FIG. 2, the higher the difference between a luminance of the individual pixel and the average luminance of all the pixels (that is, as an emission luminance of an individual pixel is higher than the average luminance of all the pixels), the higher is the luminance of the individual pixel than the luminance originally intended to be displayed. Such tendency may also be seen in the graph of FIG. 3. Furthermore, referring to the graph of FIG. 3, the luminance increase rate varies more sensitively with respect to a change in the difference between the luminance of an individual pixel and the average luminance of all the pixels as the target luminance decreases.

When the target luminance is 75%, a luminance increase rate according to the increase in the difference between the luminance of an individual pixel and the average luminance of all the pixels is relatively small. However, when the target luminance is 25%, a luminance increase rate with respect to the same difference between the luminance of an individual pixel and the average luminance of all the pixels is greater than when the target luminance is 75%. Thus, the target luminance of the individual pixel may be considered when determining the correction value for emission for the individual pixel at the target luminance.

Figure 4:
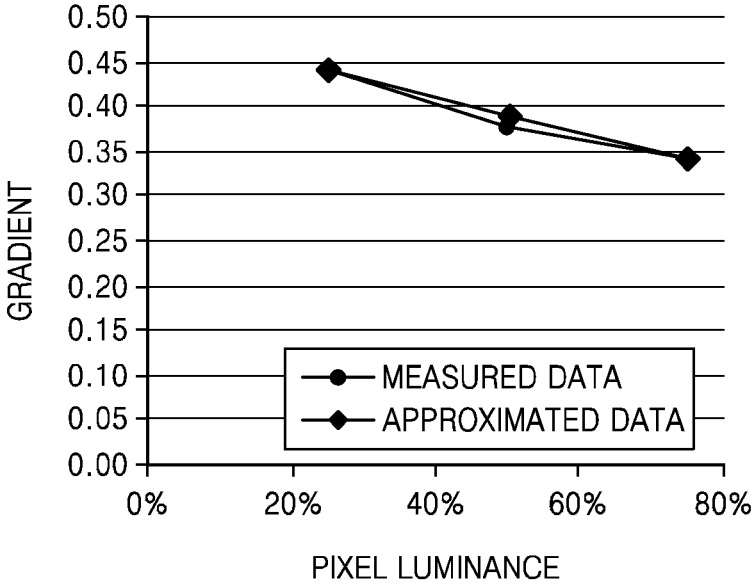
FIG. 4 is a graph showing a function of approximated gradient of luminance according to one or more exemplary embodiments.

FIG. 4 is a graph showing a function of approximated gradient of luminance according to one or more exemplary embodiments.

The graph illustrated in FIG. 4 shows actual values and approximated (modeled) values of gradient of luminance according to an emission luminance (a target luminance) of pixel.

Referring to FIG. 4, as the target luminance increases, the gradient of luminance (actual luminance variation rate) has a tendency to decrease. The organic light-emitting display device and the display method thereof according to the exemplary embodiments may consider such gradient in the correction of luminance.

As described with reference to FIG. 2, the luminance increase rate has a tendency to be approximately proportional to the difference between the luminance of the individual pixel and the average luminance of all the pixels. Thus, a luminance correction value for the individual pixel may be derived as Equation 1 below.

$$Y=A_1 \times X \quad \text{[Equation 1]}$$

Here, Y denotes the correction value, $A_1$ denotes a luminance correction rate, and X denotes a difference between the gamma data of the corresponding pixel and average gamma data of all the pixels.

The correction rate $A_1$ corresponds to a gradient of the graph illustrated in FIG. 2. Referring to FIG. 3, since the gradient of luminance according to pixel luminance has a tendency to decrease according to an increase of luminance of an individual pixel, the correction rate $A_1$, which is the gradient of luminance, may be approximated as a linear function expressed in Equation 2 below.

$$A_1=A_2 \times Z+B \quad \text{[Equation 2]}$$

Here, $A_1$ denotes the correction rate, $A_2$ denotes a gradient, Z denotes a gamma data of the corresponding pixel, and B denotes an offset.

As described above, the gamma data of a pixel corresponds to emission luminance of the pixel, and thus, when the gradient $A_2$ and the offset value B are given in Equation 2, the correction rate $A_1$ may be calculated.

A change of the gradient of luminance according to emission luminance, illustrated in the graph illustrated in FIG. 4, may be approximated as a linear function having a gradient of about −0.2 and an offset of about 0.49. Therefore, the correction rate $A_1$ may be calculated by using gamma data Z of the individual pixel.

For example, when the target luminance of pixels is 75%, the correction rate $A_1$ may be calculated as:

$$A1=-0.2*0.75+0.49=0.34,$$

and therefore, the correction value Y may be determined by substituting the above correction rate $A_1$ into Equation 1.

Referring back to Equation 1, the correction value determining unit 130 may determine a luminance correction value Y based on the correction rate $A_1$ calculated by the correction rate calculating unit 120 and a difference between the average gamma data of all the pixels and gamma data of a corresponding pixel X.

The correction value determining unit 130 may receive gamma data applied to all pixels included in the display panel 140 in order to obtain average gamma data of all the pixels (or average luminance of all the pixels).

The gradient $A_2$ and the offset B of the linear function used in calculating the correction rate $A_1$ may each be a uniform value regardless of colors displayed by the plurality of pixels, and may also be different according to the color displayed by the plurality of pixels. As a gradient of an actual display luminance according to emission luminance of an individual pixel may be different according to the displayed colors, an accuracy of luminance correction may be increased by using different gradients $A_2$ and different offsets B according to the displayed colors.

However, a uniform gradient $A_2$ and a uniform offset B may be used regardless of the displayed color types considering the complexity of hardware structure.

The correction value determining unit 130 needs the correction rate $A_1$, gamma data of a pixel, the luminance of which is to be corrected, and average gamma data of all the pixels (average luminance of all the pixels) in order to determine the luminance correction value Y of the pixel to be corrected.

The correction rate calculating unit 120 may receive and store gamma data that is applied to each of the plurality of pixels, calculate average gamma data of all the pixels based on the received gamma data, and provide the correction value determining unit 130 with gamma data of the pixel to be corrected and the average gamma data of all the pixels.

Also, the correction rate calculating unit 120 may further include a memory device to store the gamma data applied to each of the plurality of pixels every frame.

Figure 5:
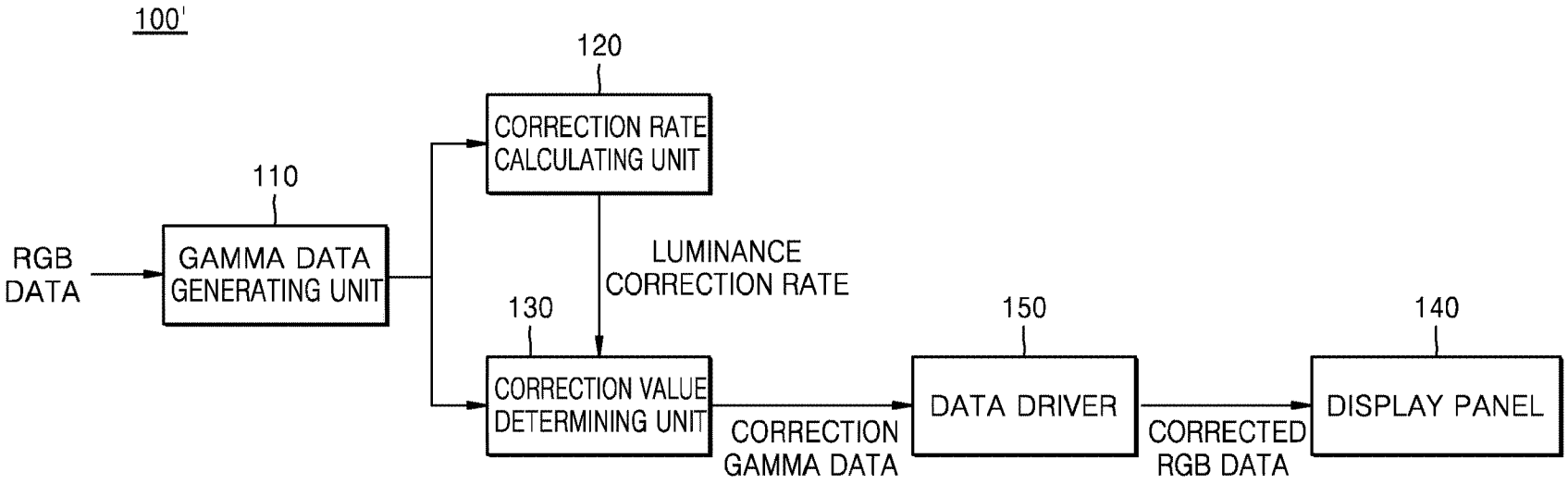
FIGS. 5 and 6 are schematic structural diagrams illustrating an organic light-emitting display device according to one or more exemplary embodiments.
Figure 6:
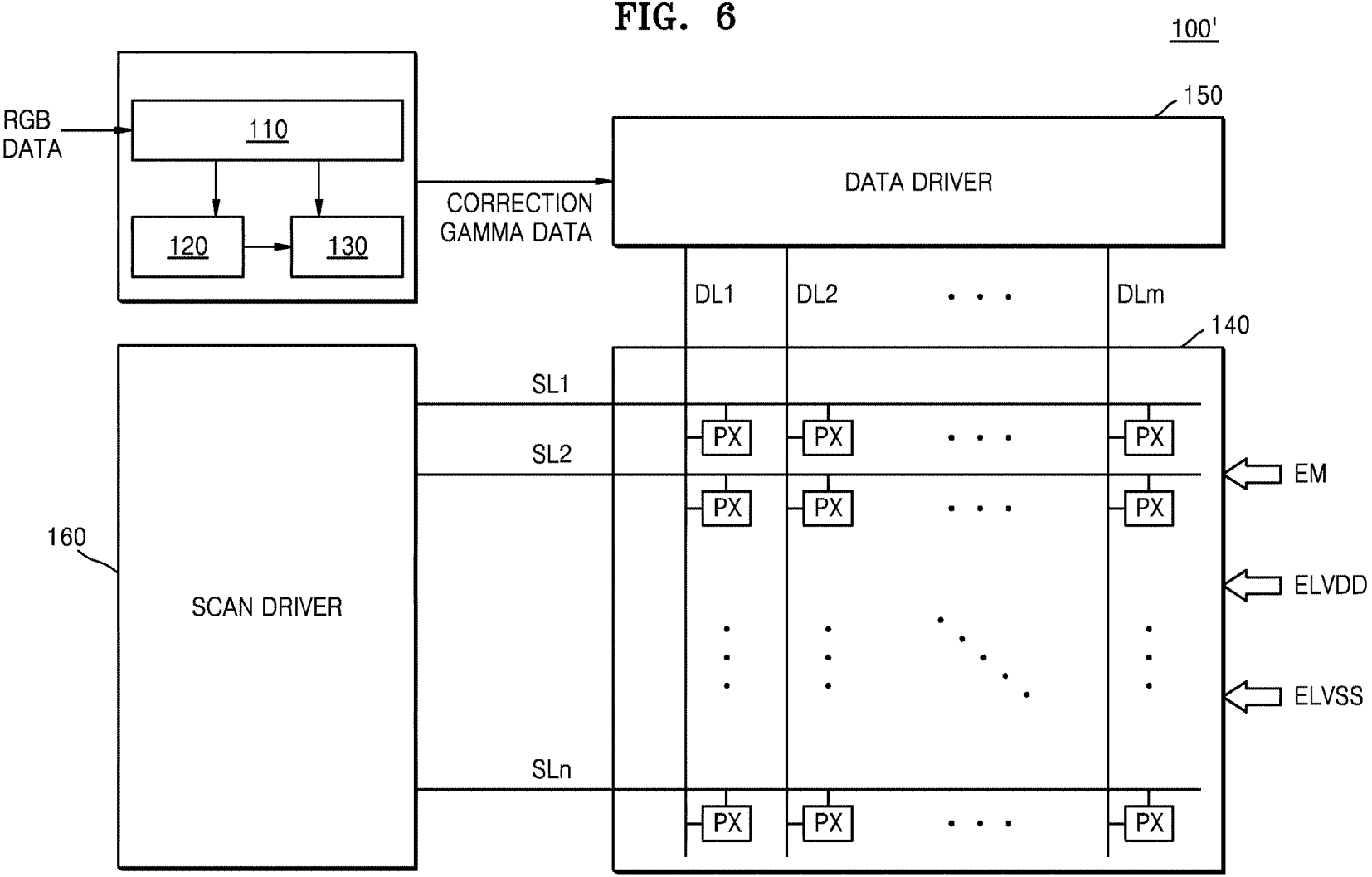

FIGS. 5 and 6 are schematic structural diagrams illustrating an organic light-emitting display device 100' according to one or more exemplary embodiments.

The organic light-emitting display device 100' illustrated in FIG. 5 further includes a data driver 150, compared to the organic light-emitting display device 100 illustrated in FIG. 1. The data driver 150 is configured to provide the display panel 140 with corrected RGB data corresponding to correction gamma data to which correction values are applied, wherein the correction values respectively correspond to a plurality of pixels included in the display panel 140.

Referring to FIG. 6, the display panel 140 includes a plurality of pixels PX arranged in a matrix at locations where scan lines SL1 to SLn arranged in rows and data lines DL1 to DLm arranged in columns cross each other. Each of the plurality of pixels PX may receive a scan signal and a data signal from the scan lines SL1 to SLn and the data lines DL1 to DLm, respectively.

As illustrated in FIG. 6, the display panel 140 may be a light-emitting diode panel that operates by receiving an emission signal EM, a driving voltage ELVDD, and a ground voltage ELVSS.

The data driver 150 may receive correction gamma data from the correction value determining unit 130, and supply a data signal corresponding to corrected RGB data to the pixels PX through the data lines DL1 to DLM in response to a data control signal.

A scan driver 160 receives a scan control signal to generate a scan signal. Also, the scan driver 160 may supply the generated scan signal to the pixels PX through the scan lines SL1 to SLn. The pixels PX may be sequentially selected row-by-row according to the scan signal to supply a data signal.

In exemplary embodiments, the gamma data generating unit 110, the correction rate calculating unit 120, the correction value determining unit 130, the data driver 150, the scan driver 160, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, processes, etc., described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the gamma data generating unit 110, the correction rate calculating unit 120, the correction value determining unit 130, the data driver 150, the scan driver 160, and/or one or more components thereof may include or otherwise be associated with one or more memories (not shown) including code (e.g., instructions) configured to cause the gamma data generating unit 110, the correction rate calculating unit 120, the correction value determining unit 130, the data driver 150, the scan driver 160, and/or one or more components thereof to perform one or more of the features, functions, processes, etc., described herein.

The memories may be any medium that participates in providing code to the one or more software, hardware, and/or firmware components for execution. Such memories may be implemented in any suitable form, including, but not limited to, non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a compact disk-read only memory (CD-ROM), a rewriteable compact disk (CDRW), a digital video disk (DVD), a rewriteable DVD (DVD-RW), any other optical medium, punch cards, paper tape, optical mark sheets, any other physical medium with patterns of holes or other optically recognizable indicia, a random-access memory (RAM), a programmable read only memory (PROM), and erasable programmable read only memory (EPROM), a FLASH-EPROM, any other memory chip or cartridge, a carrier wave, or any other medium from which information may be read by, for example, a controller/processor.

Figure 7:
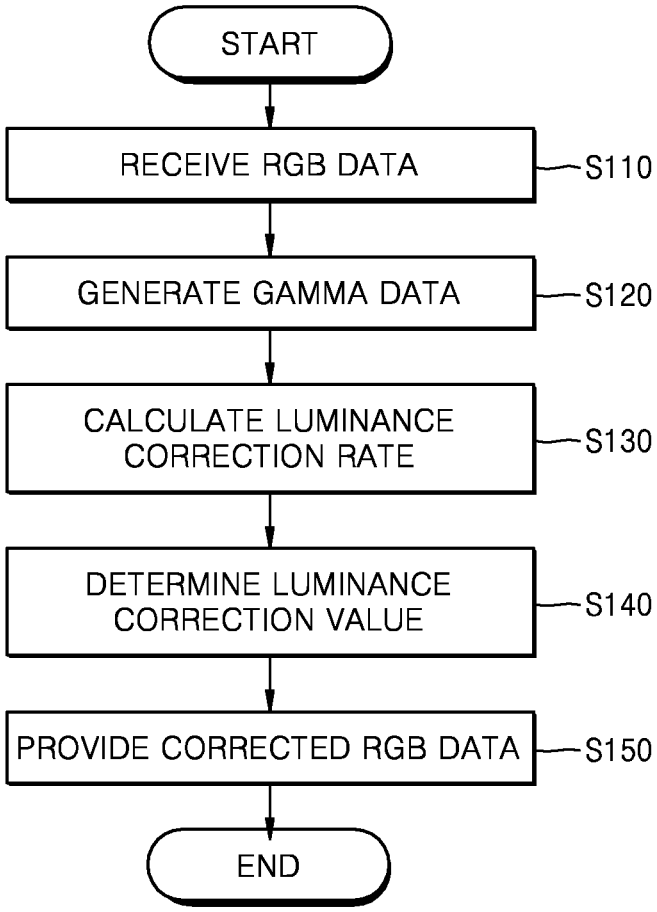
FIG. 7 is a flowchart of a display method according to one or more exemplary embodiments.

FIG. 7 is a flowchart of a display method according to one or more exemplary embodiments.

According to the display method of the present exemplary embodiment, a display panel that includes a plurality of pixels including an organic light-emitting device is used, and the plurality of pixels each display one of a plurality of colors including, but not limited to, red, green, and blue colors. The method includes: receiving RGB data (S110), generating gamma data from the received RGB data (S120); calculating a luminance correction rate of each of the plurality of pixels based on the gamma data of each of the plurality of pixels (S130); determining a luminance correction value of a color displayed on each of the plurality of pixels (S140); and providing corrected RGB data, wherein the luminance correction value is applied to the corrected RGB data (S150).

In the calculating a luminance correction rate (S130), the luminance correction rate may be calculated by taking into account the colors respectively displayed by the plurality of pixels.

The correction rate may be calculated by using a linear function having different gradients and different offsets according to colors respectively displayed by the plurality of pixels, or a linear function having the same gradient and the same offset regardless of colors.

For example, in operation S130, the luminance correction rate may be calculated by using Equation 3 below.

$$A_1 = A_2 \times Z + B \quad \text{[Equation 3]}$$

Here, $A_1$ denotes a correction rate, $A_2$ denotes a gradient, Z denotes gamma data of a corresponding pixel, and B denotes an offset.

In operation S140 of determining a luminance correction value, the luminance correction value may be determined based on the correction rate calculated in operation S130 and a difference between average gamma data of all the pixels and gamma data of a corresponding pixel. For example, the luminance correction value may be determined by using Equation 4 below.

$$Y = A_1 \times X \quad \text{[Equation 4]}$$

Here, Y denotes a correction value, $A_1$ denotes a correction rate, and X denotes a difference between gamma data of a corresponding pixel and average gamma data of all the pixels.

Figure 8:
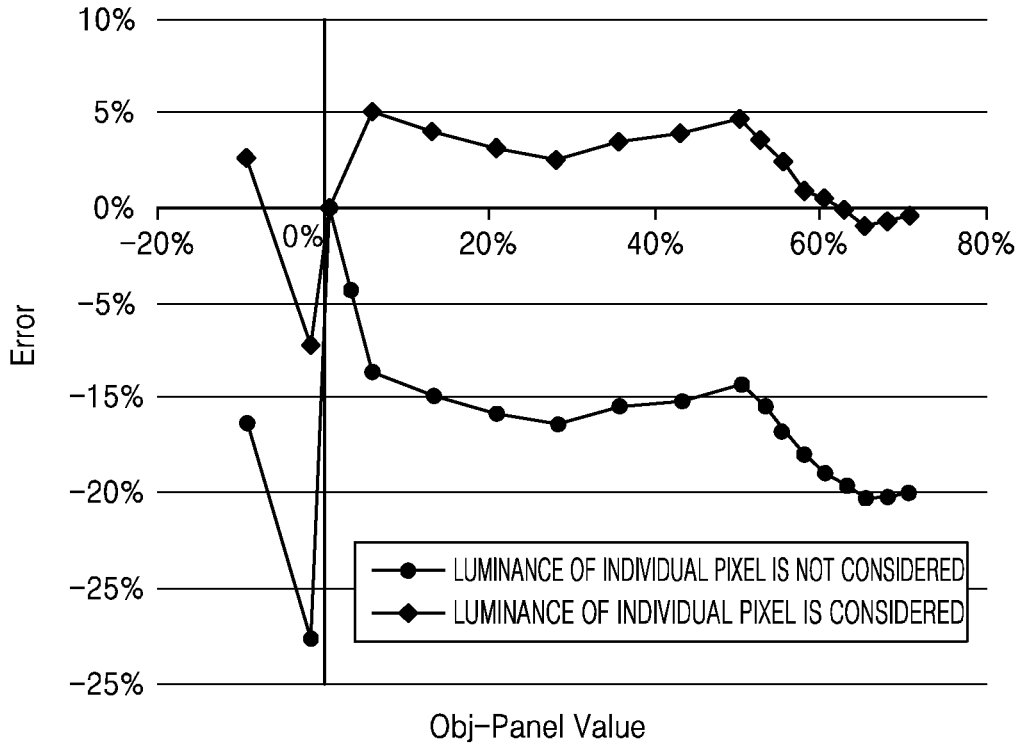
FIG. 8 is a graph showing a luminance correction effect according to an organic light-emitting display device or a display method according to one or more exemplary embodiments.

FIG. 8 is a graph showing a luminance correction effect according to an organic light-emitting display device or a display method according to one or more exemplary embodiments.

The graph illustrated in FIG. 8 shows each correction accuracy when a luminance of an individual pixel is considered, and when the luminance of the individual pixel is not considered.

In the graph of FIG. 8, the horizontal axis denotes a difference obtained by subtracting an average luminance of all the pixels from a luminance of an individual pixel (Obj−panel value), and the vertical axis denotes a difference (error) between a target emission luminance and an actual luminance in percentage. The graph of FIG. 8 shows an example where 75% luminance is intended in a pixel that displays a red color, with respect to a maximum luminance of 100%.

Referring to the graph illustrated in FIG. 8, when the luminance of an individual pixel is taken into account, the actual emission luminance may be closer to the target emission luminance compared to when the luminance of the individual pixel is not taken into account.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An organic light-emitting display device comprising:

a display panel comprising a plurality of pixels, each of the plurality of pixels comprising an organic light-emitting device configured to emit colored light;

a gamma data generating unit configured to generate gamma data corresponding to received RGB data;

a correction rate calculating unit configured to determine a luminance correction rate of each of the plurality of pixels based on the gamma data respectively corresponding to the plurality of pixels; and a correction value determining unit configured to determine a luminance correction value of a color displayed via each of the plurality of pixels, wherein the correction rate calculating unit is configured to determine the luminance correction rate according to a linear function dependent upon different gradients and different offsets according to the color displayed via the plurality of pixels, wherein the correction rate calculating unit is configured to determine the luminance correction rate according to the following equation:

$A_1=A_2\times Z+B$, and wherein A1 denotes a luminance correction rate, A2 denotes a gradient, Z denotes gamma data of a corresponding pixel, and B denotes an offset.

2. The organic light-emitting display device of claim 1, wherein the correction value determining unit is configured to determine a luminance correction value based on the luminance correction rate determined via the correction rate calculating unit and a difference between average gamma data of the plurality of pixels and gamma data of a corresponding pixel.

3. The organic light-emitting display device of claim 2, where the correction value determining unit is configured to determine the correction value according to the following equation:

$Y=A_1\times X$, wherein Y denotes a correction value, A1 denotes a luminance correction rate, and X denotes a difference between gamma data of a corresponding pixel and average gamma data of the plurality of pixels.

4. The organic light-emitting display device of claim 1, further comprising:

a data driver configured to provide the display panel with corrected RGB data corresponding to correction gamma data, wherein a correction value corresponding to each of the plurality of pixels is applied to the correction gamma data.

5. The organic light-emitting display device of claim 1, wherein the correction rate calculating unit is configured to:

receive and store the gamma data applied to each of the plurality of pixels;

determine average gamma data of the plurality of pixels based on the received gamma data; and provide the correction value determining unit with gamma data of the pixel to be corrected and the average gamma data of the plurality of pixels.

6. The organic light-emitting display device of claim 1, wherein the colored light corresponds to at least one of red, green, and blue colored light.

7. A method comprising:

receiving RGB data associated with driving a display panel comprising a plurality of pixels, the plurality of pixels respectively comprising an organic light-emitting device configured to emit colored light;

generating gamma data corresponding to the RGB data;

determining a luminance correction rate for each pixel of the plurality of pixels based on the gamma data respectively corresponding to the plurality of pixels; and determining a luminance correction value of a color displayed via each of the plurality of pixels; and providing corrected RGB data corresponding to correction gamma data to a pixel corresponding to the corrected RGB data, wherein the luminance correction value is applied to the correction gamma data, and wherein determining the luminance correction rate comprises:

determining the correction rate according to a linear function dependent upon different gradients and different offsets according to a color displayed via each of the plurality of pixels, wherein determining the luminance correction rate comprises:

determining the luminance correction rate according to the following equation:

$A_1=A_2\times Z+B$, and wherein A1 denotes a luminance correction rate, A2 denotes an gradient, Z denotes gamma data of a corresponding pixel, and B denotes an offset.

8. The method of claim 7, wherein determining the luminance correction value comprises:

determining the luminance correction value based on the luminance correction rate and a difference between average gamma data of the plurality of pixels and gamma data of a corresponding pixel.

9. The method of claim 8, wherein determining the luminance correction value comprises:

determining the luminance correction value according to the following equation:

$Y=A_1\times X$, wherein Y denotes a correction value, A1 denotes a luminance correction rate, and X denotes a difference between gamma data of a corresponding pixel and average gamma data of all the pixels.

10. The method of claim 7, wherein the colored light corresponds to at least one of red, green, and blue colored light.

* * * * *